US008777029B2

(12) United States Patent
Paredes et al.

(10) Patent No.: US 8,777,029 B2
(45) Date of Patent: Jul. 15, 2014

(54) BOTTLE WITH BRIDGE AND FLUID CHANNEL

(71) Applicant: Owens-Brockway Glass Container Inc., Perrysburg, OH (US)

(72) Inventors: Raul M. Paredes, Perrysburg, OH (US); Douglas Laib, Perrysburg, OH (US); Allan Henderson, Cincinnati, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 9 days.

(21) Appl. No.: 13/720,105

(22) Filed: Dec. 19, 2012

(65) Prior Publication Data

US 2014/0166605 A1 Jun. 19, 2014

(51) Int. Cl.
*B65D 1/02* (2006.01)

(52) U.S. Cl.
CPC ..... *B65D 1/023* (2013.01)
USPC ..... 215/40; 215/383; 215/382; 220/673; 220/669; 222/572

(58) Field of Classification Search
USPC ..... D9/530, 537, 539, 540, 543, 549, 558, D9/575, 579; 215/40, 381–385, 902, 215/365–366, 379, 386–389; 222/478, 481, 222/569, 572; 206/459.5; 220/660, 220/669–675
See application file for complete search history.

(56) References Cited

U.S. PATENT DOCUMENTS

| | | | | | |
|---|---|---|---|---|---|
| 1,773,291 | A | | 8/1930 | Weaver | |
| D85,487 | S | | 3/1931 | Meyer | |
| 1,997,914 | A | * | 4/1935 | Pollard | 215/389 |
| 3,145,868 | A | | 8/1964 | Roberts et al. | |
| 4,573,595 | A | | 3/1986 | Mednis | |
| 4,832,211 | A | | 5/1989 | Matthews et al. | |
| 4,838,464 | A | | 6/1989 | Briggs | |
| 4,949,861 | A | * | 8/1990 | Cochran | 215/42 |
| 5,067,622 | A | * | 11/1991 | Garver et al. | 215/381 |
| D335,455 | S | * | 5/1993 | Brown | D9/537 |
| 5,289,953 | A | * | 3/1994 | McMillan et al. | 222/189.07 |
| 5,330,054 | A | * | 7/1994 | Brown | 206/459.5 |
| 5,340,000 | A | * | 8/1994 | Ring | 222/468 |
| 5,964,383 | A | * | 10/1999 | Cargile | 222/571 |
| 6,070,753 | A | * | 6/2000 | Hirst et al. | 220/674 |

(Continued)

FOREIGN PATENT DOCUMENTS

| | | |
|---|---|---|
| EP | 2325092 | 5/2011 |
| WO | WO 92/12901 A1 | 8/1992 |

OTHER PUBLICATIONS

PCT Search Report and Written Opinion, Int Serial No. PCT/US2013/071980, Int Filing Date: Nov. 26, 2013, Applicant: Owens-Brockway Glass Container Inc., Mail Date: Feb. 17, 2014.

*Primary Examiner* — Mickey Yu
*Assistant Examiner* — Brijesh V. Patel

(57) ABSTRACT

A bottle includes a bridge forming a fluid channel, and extending radially outwardly on a bottle neck, from a location spaced axially from a bottle finish to a bottle shoulder. The bridge includes an outer wall offset radially outwardly with respect to walls of the neck and the shoulder and, in transverse cross section, the outer wall includes an incurvate inner surface. The bridge also includes side walls extending between the outer wall of the bridge and the walls of the neck and shoulder and, in transverse cross section, the side walls include straight inner surfaces disposed at chordal angles.

20 Claims, 4 Drawing Sheets

(56) References Cited

U.S. PATENT DOCUMENTS

| | | | | |
|---|---|---|---|---|
| 6,085,949 | A * | 7/2000 | Zimny et al. | 222/572 |
| 6,123,211 | A * | 9/2000 | Rashid et al. | 215/12.1 |
| 6,305,562 | B1 | 10/2001 | Chan et al. | |
| 6,726,044 | B1 | 4/2004 | Deubel et al. | |
| 6,758,357 | B2 | 7/2004 | Grillo | |
| D646,977 | S | 10/2011 | Martin | |
| 2005/0040130 | A1 | 2/2005 | Bivens | |
| 2008/0173613 | A1* | 7/2008 | Ross | 215/379 |
| 2008/0190884 | A1* | 8/2008 | Maczek et al. | 215/381 |
| 2008/0210715 | A1 | 9/2008 | Tanaka | |
| 2008/0230573 | A1* | 9/2008 | Enahoro | 222/571 |
| 2009/0053374 | A1 | 2/2009 | Finn | |
| 2010/0181278 | A1 | 7/2010 | Martin | |
| 2010/0264107 | A1 | 10/2010 | Lonsway et al. | |
| 2011/0108505 | A1 | 5/2011 | Toyoda et al. | |
| 2011/0174769 | A1* | 7/2011 | Jung, II | 215/383 |
| 2011/0210092 | A1 | 9/2011 | Meager | |
| 2012/0000878 | A1 | 1/2012 | Reisig | |

* cited by examiner

BOTTLE WITH BRIDGE AND FLUID CHANNEL

The present disclosure is directed to containers and, more particularly, to bottles.

BACKGROUND AND SUMMARY OF THE DISCLOSURE

Bottles typically include a body, a shoulder, a neck, and a neck finish. U.S. Patent Application Publication 2012/0000878 illustrates an example glass bottle of this general type. Such bottles may be produced using a blow-and-blow manufacturing process or a press-and-blow manufacturing process, and typically have substantially uniform wall thicknesses. Moreover, longneck bottles are popular in the beverage packaging industry, particularly for packaging beer. U.S. Patent Application Publication 2010/0264107 illustrates example longneck bottles having necks with internal ribs produced by forming external ribs on necks of parisons and pushing the external ribs into the necks during blowing of the parisons into the bottles.

A general object of the present disclosure, in accordance with one aspect of the disclosure, is to provide a bottle that includes abridge establishing a fluid channel for improved product dispensing, and that does not require unconventional neck ring equipment or an unconventional closure design for the container.

The present disclosure embodies a number of aspects that can be implemented separately from or in combination with each other.

A glass bottle in accordance with one aspect of the disclosure includes a body, a shoulder at one end of the body, a neck extending from the shoulder, and a finish at an end of the neck spaced from the shoulder, wherein the base, the shoulder, the neck, and the finish have circular cross sections coaxial about a longitudinal axis of the bottle. The bottle is characterized in that a bridge forms a fluid channel for pouring or venting depending upon orientation of the bottle during pouring, and extends radially outwardly on the neck, from a location spaced axially from the finish to the shoulder. The bridge includes an outer wall offset radially outwardly with respect to walls of the neck and the shoulder. The outer wall includes, in transverse cross section, an incurvate inner surface. The bridge also includes a pair of side walls extending between the outer wall of the bridge and the walls of the neck and shoulder. The side walls include, in transverse cross section, straight inner surfaces disposed at chordal angles with respect to the circular cross sections. The fluid channel is established between the inner surface of the bridge outer wall and inner surfaces of the neck and shoulder walls.

In accordance with another aspect of the disclosure, there is provided a bottle that extends along a longitudinal axis and includes, a base, a body extending from the base, a shoulder extending from the body and including a shoulder wall, a neck extending from the shoulder and including a neck wall, and a finish terminating the neck. The bottle also includes a bridge forming a fluid channel, and extending radially outwardly from and longitudinally along the neck at a non-zero angle with respect to the longitudinal axis, from a location spaced axially from the finish, toward the body, and across at least a portion of the shoulder. The bridge includes an outer wall that is offset radially outwardly with respect to the walls of the neck and the shoulder and, in transverse cross section, has an incurvate inner surface. The bridge also includes side walls extending between the outer wall of the bridge and the walls of the neck and shoulder and, in transverse cross section, having straight inner surfaces disposed at chordal angles.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
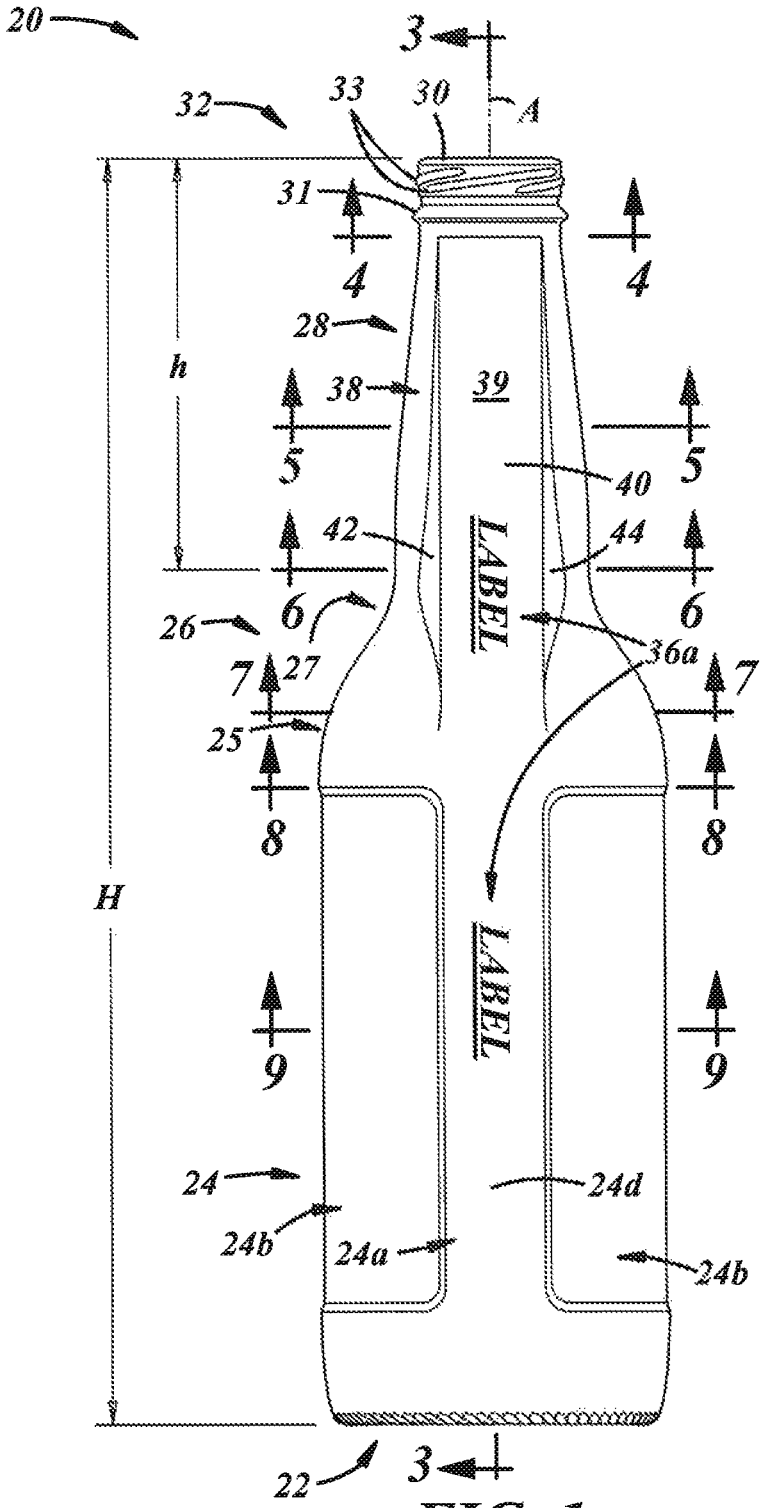
FIG. 1 is a front devotional view of a bottle having abridge that establishes a fluid channel, in accordance with an illustrative embodiment of the present disclosure.
Figure 2:
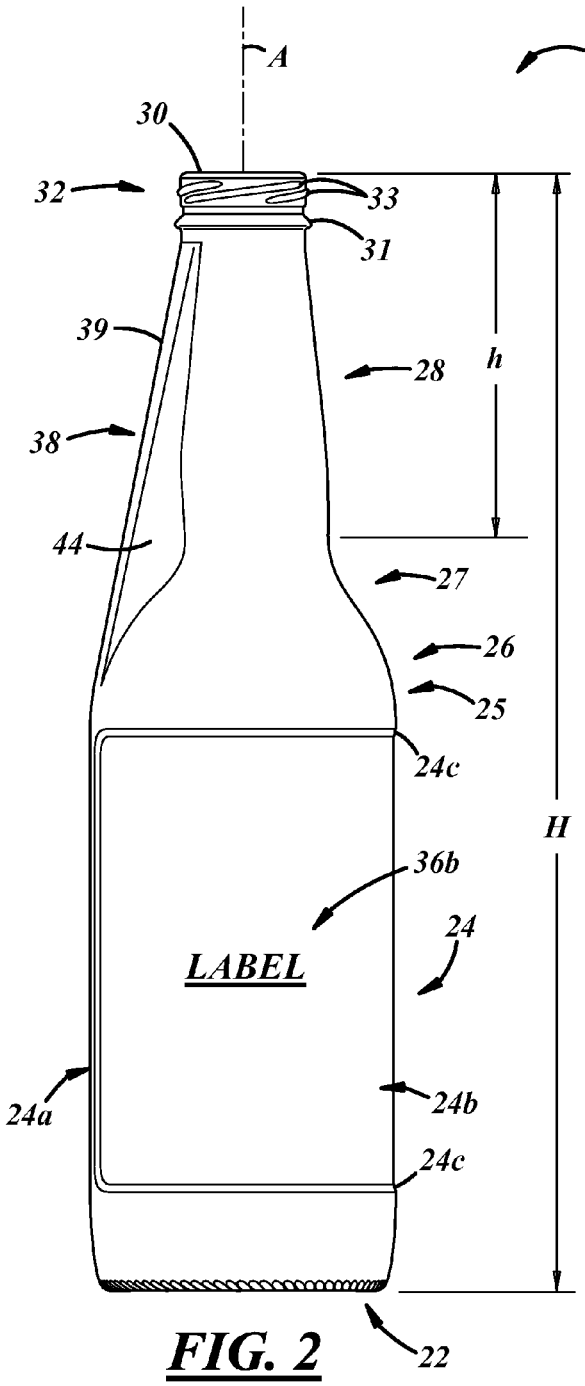
FIG. 2 is aside elevational view of the bottle of FIG. 1.

FIGS. 1 and 2 illustrate bottle 20 extending along a longitudinal central axis A in accordance with one illustrative embodiment of the present disclosure. The bottle 20 may include a closed bas 22, a body 24 extending longitudinally from the base 22 at one end of the body 24, a shoulder 26 extending longitudinally and radially inwardly from another end of the body 24, and a neck 28 extending longitudinally from the shoulder 26 to and including a lip 30. The bottle 20 also includes a neck finish 32 axially spaced from the shoulder 26 and terminating the neck 28, and including one or more features for attachment of a desired closure (not shown). For example, the neck finish 32 may include a capping flange 31, and one or more threads or thread segments 33 to cooperate with corresponding thread segments on a threaded type of closure. As used herein, the term thread segment includes whole, partial, multiple, and/or an interrupted thread and/or thread segment. The neck finish 32 can instead include a crown thereon for engagement with a crimping type of closure, or any other suitable closure attachment features. The bottle 20 may be used for containing, for example, a beverage, for instance, beer, wine, spirits, soda, or the like, or any other any flowable product.

As will be described in further detail below, the neck 28 and shoulder 26 may be vented. For example, the bottle 20 also includes a bridge 38 that forms or establishes a fluid channel 37 (FIGS. 3, 5, and 6) for pouring or venting depending upon orientation of the bottle 20 during pouring. The bridge 38 may extend radially outwardly on or from and longitudinally along at least portions of the neck 28 and the shoulder 26. For example, the bridge 38 may extend longitudinally between the body 24 and the neck 28 and at least partly over the shoulder 26. More specifically, the bridge 38 may extend radially outwardly from the neck 28 and longitudinally from a location spaced axially from the finish 32, toward the body 24, over an incurvate portion 27 of the shoulder 26, and to an excurvate portion 25 of the shoulder 26. Accordingly, the bridge 38 may extend along a portion of the neck 28 or along the entire neck 28 except for the finish 32 itself. As used herein, the terms axial and longitudinal include being oriented generally along the longitudinal axis A and may include but are not limited to a direction that is strictly parallel to the axis A.

The bridge 38 extends longitudinally at a non-zero angle with respect to the axis A. The bridge 38 may be oriented at an angle a with respect to the longitudinal axis A. The angle a may be, for example, between 8 and 30 degrees and including all subranges therebetween. More particularly, the angle a may be between 10 and 12 degrees. In a conventional long-neck bottle, an upper or incurvate (with respect to the axis A) portion of a shoulder presents a bump or obstacle over which product must flow when being dispensed or poured out of the bottle.

Figure 3:
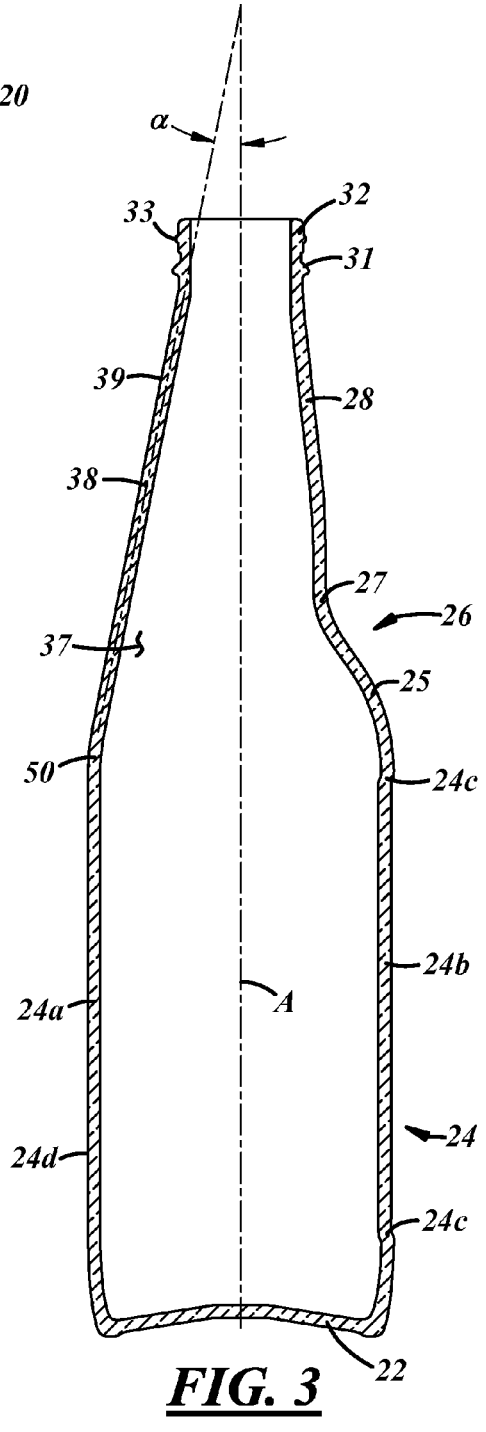
FIG. 3 is a longitudinal cross-sectional view of the bottle of FIG. 1, taken along line 3-3 of FIG. 1.
Figure 4:
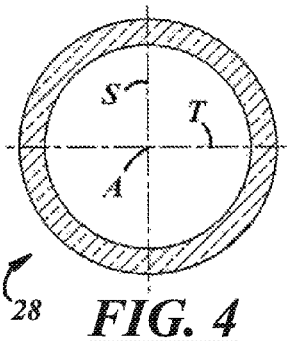
FIG. 4 is a transverse cross-sectional view of the bottle of FIG. 1, taken along line 4-4 of FIG. 1 through a space between a bridge and a finish.
Figure 6:
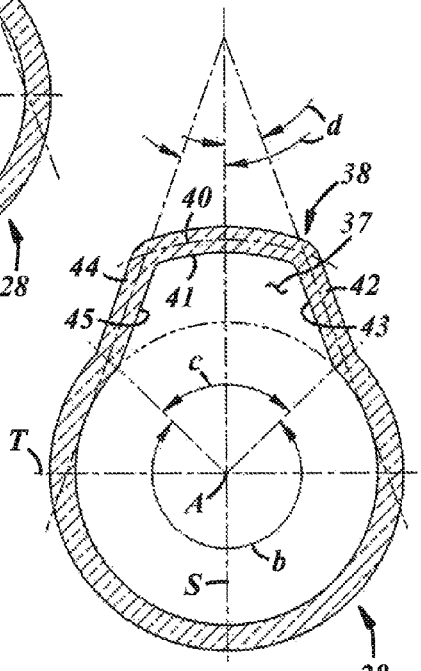
FIG. 6 is a transverse cross-sectional of the bottle of FIG. 1, taken along line 6-6 of FIG. 1 through the neck and the bridge.
Figure 7:
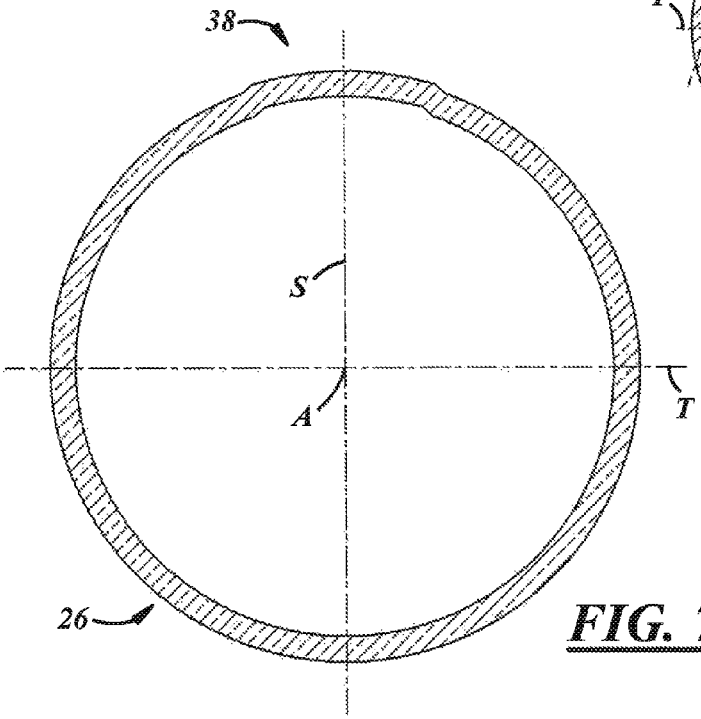
FIG. 7 is a transverse cross-sectional view of the bottle of FIG. 1, taken along line 7-7 of FIG. 1 through a shoulder and the bridge.

But, with reference to FIGS. 3 and 6, the presently disclosed bridge 38 provides the shoulder bypass channel 37 for a direct and smooth flow of product from the body 24 to the neck 28 when pouring product out of the bottle 20 when the bridge 38 is oriented in a downward position. And when pouring with the bridge 38 oriented in an upward position, air is vented through the channel 37 of the bridge 38 into the body 24, also allowing for a relatively smooth flow of product over the shoulder 26. Accordingly, the channel 37 may be a pour channel or a vent channel depending upon orientation of the bottle 20 during dispensing or pouring. In other words, the channel 37 may vent gas and/or convey liquid during dispensing or pouring. Accordingly, the bridge 38 and corresponding channel 37 may be used to facilitate smooth product flow out of the bottle 20 so as to reduce "glugging" for a concomitant reduction in product agitation and head size.

With various reference to FIGS. 4 through 9, the body 24 (FIGS. 8 and 9), the shoulder 26 (FIG. 7), and the neck 28 (FIGS. 5 and 6), each may have generally circular cross sections, which may be coaxial with one another. For example, the neck 28 and the neck finish 32 may include cross sections transverse to the axis A that are coaxial and circular. For instance, the neck finish 32 may be completely circular in cross section, extending 360 angular degrees. More specifically, the neck finish 32 may have a neck finish wall with internal and/or external surfaces that are completely circular in cross section. As used herein, the term "circular" includes something relating to a circle or its mathematical properties and need not be a fully circumferentially continuous circle and, in fact, may include a semi-circle or arc.

In accordance with the present disclosure, at least a portion of the bottle neck 28 is provided with a non-circular internal surface, in transverse cross section, for affecting flow of product through the bottle neck 28 during dispensing or pouring. More specifically, the neck 28 may be partially circular in cross section in locations axially between the neck finish 32 and the shoulder 26. For instance, the circular cross section may be interrupted circumferentially by the bridge 38. The neck 28 may be of circular cross section and may extend circumferentially over an angle b between 240 and 300 angular degrees and all subranges therebetween. The bridge 38 may extend circumferentially over an angle c between 60 and 120 angular degrees and all subranges therebetween. More specifically, the neck 28 may be of circular cross section and may extend circumferentially between 255 and 285 angular degrees and all subranges therebetween, and the bridge may extend between 75 and 105 angular degrees and all subranges therebetween. Even more particularly, the neck 28 may be of circular cross section and may extend circumferentially about 270 angular degrees, and the bridge 38 may extend about 90 angular degrees. As used herein, the term "about" means within plus or minus 10%.

Figure 5:
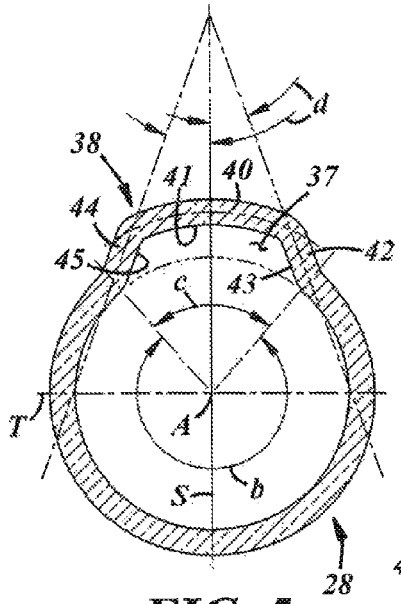
FIG. 5 is a transverse cross-sectional view of the bottle of FIG. 1, taken along line 5-5 of FIG. 1 through a neck and the bridge.

Referring to FIGS. 5 and 6, the bridge 38 includes an outer wall 40 offset radially outwardly with respect to the wall of the neck 28 and the wall of the shoulder 26. The bridge 38 also includes side walls 42, 44 extending between the wall 40 and the walls of the neck 28 and the shoulder 26. A plane of symmetry S may bisect the outer wall 40 and may extend through the longitudinal axis A, such that the longitudinal axis A lies in the plane of symmetry S. Similarly, a transverse plane T may extend through the longitudinal axis A and perpendicular to the plane of symmetry S.

In transverse cross section, the outer wall 40 may include an outer surface 39 and an inner surface 41, and the sidewalls 42, 44 may include corresponding inner surfaces 43, 45, which may be filleted for smooth transition from the outer wall 40 to the walls of the neck 28 and/or shoulder 26. The outer wall inner surface 41 may be incurvate with respect to the axis A, and radially outwardly offset from inner surfaces of the walls of the neck 28 and the shoulder 26 to establish the passage or channel 37 between the inner surfaces 41, 43, 45. The outer wall outer surface 39 may be excurvate with respect to the axis A and may be relatively smooth to accept the label 36*a* thereon. The side walls 42, 44 may be angled with respect to one another and to the outer wail 40, for example, at chordal angles d with respect to the circular cross sections of the neck 28 and/or shoulder 26. Likewise, the inner surfaces 43, 45 may be straight and disposed at chordal angles. The chordal angles d may be between 10 and 30 degrees with respect to the plane of symmetry S and, more particularly, may be between 15 and 25 degrees with respect to the plane of symmetry S and, more specifically may be about 20 degrees with respect to the plane of symmetry S. Accordingly, the side walls 42, 44 may be shaped like legs of an isosceles trapezoid. Likewise, in transverse cross section, the channel 37 may be shaped like an intersection between a trapezoid, a radially outer circular ring, and a radially inner circular area. Accordingly, the combined shape of the interior of the neck 28 and the bridge 38 may be clamshell-shaped, in transverse cross section.

Figure 8:
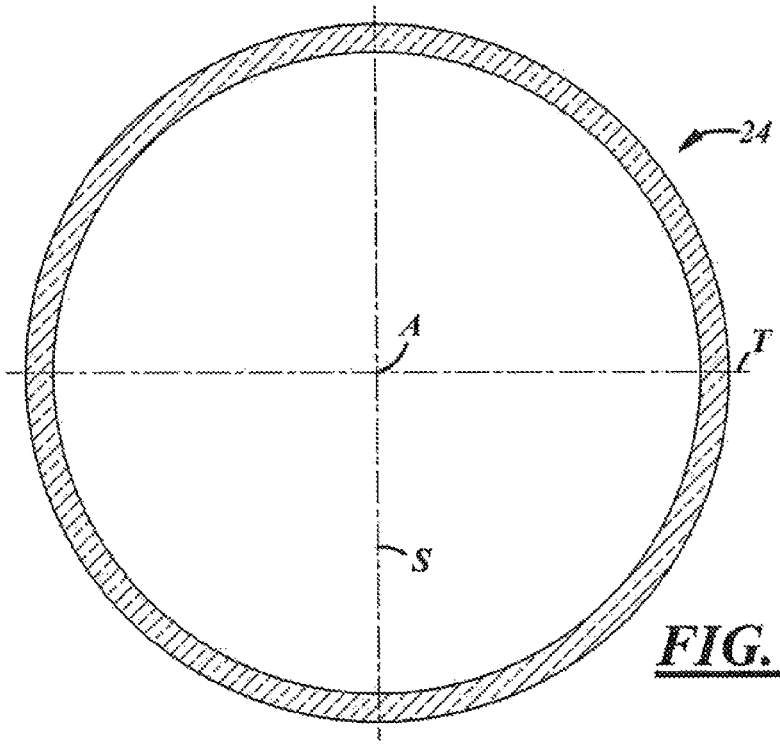
FIG. 8 is a transverse cross-sectional view of the bottle of FIG. 1, taken along line 8-8 of FIG. 1 through an upper portion of a body.
Figure 9:
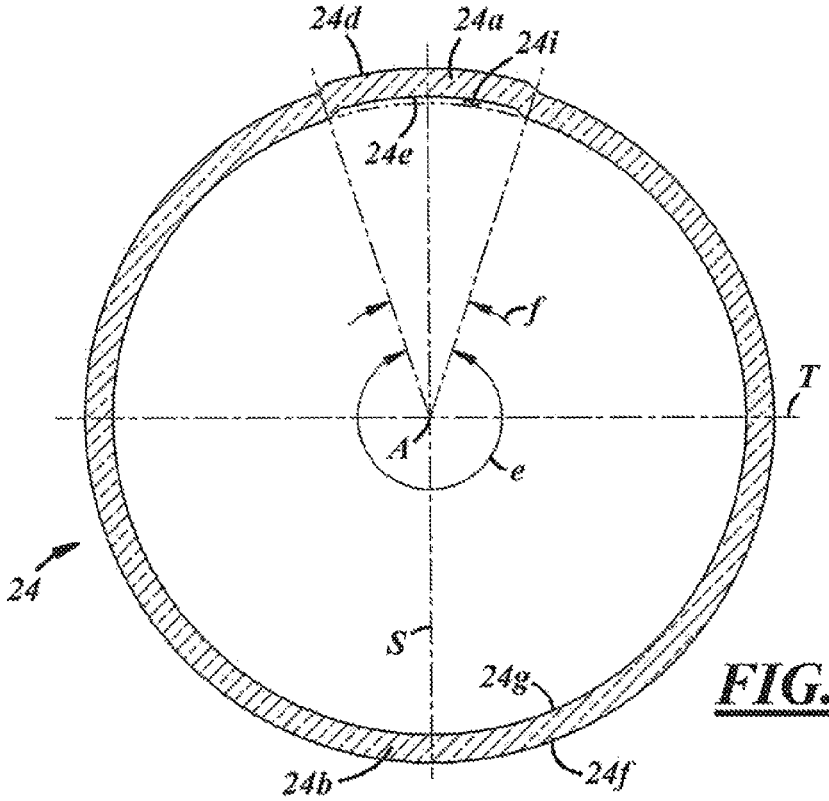
FIG. 9 is a transverse cross-sectional view of the bottle of FIG. 1, taken along line 9-9 of FIG. 1 through a middle portion of the body.

Referring to FIGS. 1, 8 and 9, the body 24 may include an outer cylindrical portion 24*a* and a recessed inner cylindrical portion 24*b*, and shoulders 24*c* (FIGS. 2 and 3) therebetween. As shown in FIG. 9, the inner cylindrical portion 24*b* may be of circular cross section and may extend circumferentially over an angle e between 315 and 335 angular degrees and all subranges therebetween, and the outer cylindrical portion may extend circumferentially over an angle f between 25 and 45 angular degrees and all subranges therebetween. The outer cylindrical portion 24*a* may include a first body diameter, and first cylindrical outer and inner surfaces 24*d*, 24*e*. The inner cylindrical portion 24*b* may include a second body diameter smaller than the first body diameter, and second cylindrical outer and inner surfaces 24*f*, 24*g* smaller in diameter than the first cylindrical outer and inner surfaces 24*d*, 24*e*. A body channel 24*i* may be established between the first and second cylindrical inner surfaces 24*e*, 24*g*.

Referring again to FIG. 3, in longitudinal cross section along the plane of symmetry S (FIGS. 4-9), the radially outer wall 40 of the bridge 38 may intersect the wall of the outer cylindrical portion 24*a* of the body 24, for example, at intersection 50. Likewise, the bridge outer surface 39 may intersect the first cylindrical outer surface 24*d* of the body 24.

Accordingly, with reference to FIG. 1, a continuous or uninterrupted surface may be established along the bridge 38 and the outer cylindrical portion 24*a* of the body 24 to accept or support one long, continuous, vertically or longitudinally extending label 36*a*, or multiple discrete labels. Also, the inner cylindrical portion 24*b* of the body 24 may accept one long, continuous, horizontally or circumferentially extending label 36*b*.

The bottle 20 may be a longneck bottle having an overall height H, and the neck 28 (including neck finish 32) having a neck height h. For purposes of the present disclosure, the term "longneck bottle" is defined as a bottle in which the height h of the bottle neck is at least 25% of the overall bottle height H. In illustrative embodiments of the present disclosure, the neck height h is in the range of 33% to 40% of bottle height H. The heights H, h may be measured to the sealing surface or lip 38 that axially terminates the neck 28 and neck finish 32. Also, the bottle 20 may be a narrow neck bottle, having a thread diameter (so-called "T" dimension) or a crown diameter (so-called "A" dimension) not more than 38 mm. The bottle 20 is of one-piece integrally formed construction, for, example, of glass, ceramic, metal, or plastic construction. (The term "integrally formed construction" does not exclude one-piece integrally molded layered glass constructions of the type disclosed for example in U.S. Pat. No. 4,740,401, or one-piece glass or metal bottles to which other structure is added after the bottle-forming operation.) Longneck glass bottles can be fabricated by press-and-blow and/or blow-and-blow manufacturing operations, or by any other suitable technique(s). The bridge and its corresponding flow channel may be formed by incorporating corresponding relieved features in press-and-blow and/or blow-and-blow molds.

There thus has been disclosed a bottle that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, including straight inner surfaces disposed at chordal angles with respect to the circular cross sections, wherein the fluid channel is established between the inner surface of the bridge outer wall and inner surfaces of the neck and shoulder walls, wherein a plane of symmetry bisects the bridge outer wall and extends through the longitudinal axis, wherein, in the transverse cross section, the side walls are shaped like legs of an isosceles trapezoid.

2. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, are straight including straight inner surfaces disposed at chordal angles with respect to the circular cross sections, wherein the fluid channel is established between the inner surface of the bridge outer wall and inner surfaces of the neck and shoulder walls, wherein a plane of symmetry bisects the bridge outer wall and extends through the longitudinal axis, and wherein the sidewalls are disposed at an angle between 8 and 30 degrees with respect to the plane of symmetry.

3. The glass bottle set forth in claim 2, wherein the sidewalls are disposed at an angle between 15 and 25 degrees with respect to the plane of symmetry.

4. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, are straight including straight inner surfaces disposed at chordal angles with respect to the circular cross sections, wherein the fluid channel is established between the inner surface of the bridge outer wall and inner surfaces of the neck and shoulder walls, wherein the neck is of circular cross section, extending between 240 and 300 angular degrees, and the bridge is of non-circular cross section extending between 60 and 120 angular degrees.

5. The glass bottle set forth in claim 4 wherein the neck is of circular cross section, extending between 255 and 285 angular degrees, and the bridge is of non-circular cross section extending between 75 and 105 angular degrees.

6. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, are straight including straight inner surfaces disposed at chordal angles with respect to the circular cross sections, wherein the fluid channel is established between the inner surface of the bridge outer wall and inner surfaces of the neck and shoulder walls, wherein the body includes a cylindrical portion having a first body diameter and a first cylindrical inner surface, and a second body diameter smaller than the first body diameter and having a second cylindrical inner surface smaller in diameter than the first cylindrical inner surface, wherein a body channel is established between the first and second cylindrical inner surfaces.

7. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, are straight including straight inner surfaces disposed at chordal angles with respect to the circular cross sections, wherein the fluid channel is established between the inner surface of the bridge outer wall and inner surfaces of the neck and shoulder walls, wherein the body includes a cylindrical portion having a first body diameter and a first cylindrical outer surface, and wherein a plane of symmetry bisects the bridge outer wall and extends through the longitudinal axis, and, in longitudinal cross section along the plane of symmetry, the radially outer wall of the bridge includes a bridge outer surface that intersects the first cylindrical outer surface at the one end of the body adjacent the shoulder.

8. A glass bottle having a body, a shoulder at one end of the body, a neck extending from the shoulder, and a finish at an end of the neck spaced from the shoulder, wherein the shoulder, the neck, and the finish have circular cross sections coaxial about a longitudinal axis of the bottle, characterized in that a bridge forms a fluid channel for pouring or venting depending upon orientation of the bottle during pouring, extends radially outwardly on the neck from a location spaced axially from the finish to the shoulder, and includes:

an outer wall offset radially outwardly with respect to walls of the neck and the shoulder and, in a transverse cross section, including an incurvate inner surface, and a pair of side walls extending between the bridge outer wall and the walls of the neck and shoulder and, in the transverse cross section, including straight inner surfaces disposed at chordal angles with respect to the circular cross sections, wherein the fluid channel is established between the inner surface of the bridge outer wall and inner surfaces of the neck and shoulder walls, wherein, in the transverse cross section, the fluid channel is shaped like an intersection between a trapezoid, a radially outer circular ring, and a radially inner circular area, and wherein a plane of symmetry bisects the bridge outer wall and extends through the longitudinal axis, and wherein the chordal angles are between 10 and 30 degrees with respect to the plane of symmetry.

9. The glass bottle set forth in claim 8 wherein, in the transverse cross section, the combined shape of the interior of the neck and the bridge is clamshell-shaped.

10. The glass bottle set forth in claim 8 wherein, in the transverse cross section, the bridge outer wall is excurvate and also includes an excurvate outer surface.

11. The glass bottle set forth in claim 8 wherein the bridge outer wall is oriented at an angle between 8 and 30 degrees with respect to the longitudinal axis.

12. The glass bottle set forth in claim 11 wherein the bridge outer wall is oriented at an angle between 10 and 12 degrees with respect to the longitudinal axis.

13. The glass bottle set forth in claim 8 wherein the bridge extends from the finish, along the neck, and over an incurvate portion of the shoulder to an excurvate portion of the shoulder.

14. A bottle extending along a longitudinal axis and that includes, a base;

a body extending from the base;

a shoulder extending from the body and including a shoulder wall;

a neck extending from the shoulder and including a neck wall;

a finish terminating the neck; and a bridge forming a fluid channel, extending radially outwardly from and longitudinally along the neck at a nonzero angle with respect to the longitudinal axis, from a location spaced axially from the finish, toward the body, and across at least a portion of the shoulder, and including:

an outer wall offset radially outwardly with respect to the walls of the neck and the shoulder and, in a transverse cross section, having an incurvate inner surface, and side walls extending between the bridge outer wall and the walls of the neck and shoulder and, in the transverse cross section, having straight inner surfaces disposed at chordal angles, wherein a plane of symmetry bisects the bridge outer wall and extends transversely through the longitudinal axis, wherein in a transverse cross section, the side walls are straight, shaped like legs of an isosceles trapezoid, and disposed at an angle between 10 and 30 degrees with respect to the plane of symmetry.

15. A bottle extending along a longitudinal axis and that includes, a base;

a body extending from the base;

a shoulder extending from the body and including a shoulder wall;

a neck extending from the shoulder and including a neck wall;

a finish terminating the neck; and a bridge forming a fluid channel, extending radially outwardly from and longitudinally along the neck at a nonzero angle with respect to the longitudinal axis, from a location spaced axially from the finish, toward the body, and across at least a portion of the shoulder, and including:

an outer wall offset radially outwardly with respect to the walls of the neck and the shoulder and, in a transverse cross section, having an incurvate inner surface, and side walls extending between the bridge outer wall and the walls of the neck and shoulder and, in the transverse cross section, having straight inner surfaces disposed at chordal angles, wherein the neck is of circular cross section, circumferentially extending between 240 and 300 angular degrees, and the bridge is of non-circular cross section extending between 60 and 120 angular degrees and oriented at an angle between 8 and 30 degrees with respect to the longitudinal axis.

16. A bottle extending along a longitudinal axis and that includes, a base;

a body extending from the base;

a shoulder extending from the body and including a shoulder wall;

a neck extending from the shoulder and including a neck wall;

a finish terminating the neck; and a bridge forming a fluid channel, extending radially outwardly from and longitudinally along the neck at a nonzero angle with respect to the longitudinal axis, from a location spaced axially from the finish, toward the body, and across at least a portion of the shoulder, and including:

an outer wall offset radially outwardly with respect to the walls of the neck and the shoulder and, in a transverse cross section, having an incurvate inner surface, and side walls extending between the bridge outer wall and the walls of the neck and shoulder and, in the transverse cross section, having straight inner surfaces disposed at chordal angles, wherein the bridge extends over an incurvate portion of the shoulder to an excurvate portion of the shoulder and does not include a bump over which product flows when being dispensed from the bottle, and wherein, in the transverse cross section, the bridge outer wall is excurvate and also includes an excurvate outer surface.

17. The bottle set forth in claim 16, wherein the body includes a cylindrical portion having a first body diameter and a first cylindrical outer surface, and wherein a plane of symmetry bisects the bridge outer wall and extends through the longitudinal axis, and, in longitudinal cross section along the plane of symmetry, the radially outer wall of the bridge includes a bridge outer surface that intersects the first cylindrical outer surface at an upper end of the body adjacent the shoulder.

18. A bottle extending along a longitudinal axis and that includes, a base;

a body extending from the base;

a shoulder extending from the body and including a shoulder wall;

a neck extending from the shoulder and including a neck wall;

a finish terminating the neck; and a bridge forming a fluid channel, extending radially outwardly from and longitudinally along the neck at a nonzero angle with respect to the longitudinal axis, from a location spaced axially from the finish, toward the body, and across at least a portion of the shoulder, and including:

an outer wall offset radially outwardly with respect to the walls of the neck and the shoulder and, in a transverse cross section, having an incurvate inner surface, and side walls extending between the bridge outer wall and the walls of the neck and shoulder and, in the transverse cross section, having straight inner surfaces disposed at chordal angles, wherein the body includes a cylindrical portion having a first body diameter and a first cylindrical inner surface, and a second body diameter smaller than the first body diameter and having a second cylindrical inner surface smaller in diameter than the first cylindrical inner surface, wherein a body channel is established between the first and second cylindrical inner surfaces.

19. A bottle extending along a longitudinal axis and that includes, a base;

a body extending from the base;

a shoulder extending from the body and including a shoulder wall;

a neck extending from the shoulder and including a neck wall;

a finish terminating the neck; and a bridge forming a fluid channel, extending radially outwardly from and longitudinally along the neck at a nonzero angle with respect to the longitudinal axis, from a location spaced axially from the finish, toward the body, and across at least a portion of the shoulder, and including:

an outer wall offset radially outwardly with respect to the walls of the neck and the shoulder and, in a transverse cross section, having an incurvate inner surface, and side walls extending between the bridge outer wall and the walls of the neck and shoulder and, in the transverse cross section, having straight inner surfaces disposed at chordal angles, wherein the fluid channel is shaped like an intersection between a trapezoid, a radially outer circular ring, and a radially inner circular area, such that the shape of the interior of the neck and the bridge is clamshell-shaped, and wherein a plane of symmetry bisects the bridge outer wall and extends through the longitudinal axis, and wherein the chordal angles are between 15 and 25 degrees with respect to the plane of symmetry.

20. The bottle set forth in claim 19 wherein the bottle is a longneck bottle.

* * * * *